US006941085B2

(12) United States Patent
Nakano et al.

(10) Patent No.: US 6,941,085 B2
(45) Date of Patent: Sep. 6, 2005

(54) TRANSFER MEMBER CLEANING METHOD AND IMAGE FORMING APPARATUS

(75) Inventors: Nobuhiko Nakano, Nara (JP); Mitsuhiro Hasegawa, Yamatokooriyama (JP); Shigeyuki Wakada, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 23 days.

(21) Appl. No.: 10/454,983

(22) Filed: Jun. 4, 2003

(65) Prior Publication Data

US 2004/0001726 A1 Jan. 1, 2004

(30) Foreign Application Priority Data

Jun. 26, 2002 (JP) ..... 2002-186702

(51) Int. Cl.[7] ..... G03G 15/16

(52) U.S. Cl. ..... 399/66; 399/71; 399/101; 399/170

(58) Field of Search ..... 399/66, 71, 101, 399/170

(56) References Cited

U.S. PATENT DOCUMENTS 5,568,230 A * 10/1996 Reddy et al. ..... 399/100
5,621,509 A * 4/1997 Karashima et al. ..... 399/46
5,832,335 A * 11/1998 Fukasawa ..... 399/66
6,148,159 A * 11/2000 Shiraishi ..... 399/44
6,173,135 B1 * 1/2001 Yuminamochi et al. ..... 399/66
6,370,345 B2 * 4/2002 Sasai ..... 399/101

FOREIGN PATENT DOCUMENTS

| | | |
|---|---|---|
| JP | 01-319078 | 12/1989 |
| JP | 10-282816 | 10/1998 |
| JP | 2000-122450 | 4/2000 |

* cited by examiner

*Primary Examiner*—Arthur T. Grimley
*Assistant Examiner*—Peter Lee
(74) *Attorney, Agent, or Firm*—David G. Conlin; David A. Tucker; Edwards & Angell, LLP

(57) ABSTRACT

A surface of a photosensitive body is charged and exposed to light to form an electrostatic latent image that is developed with toner having the same polarity as the surface. The toner image is transferred to a transfer material. During non-image forming periods a first step of applying a first voltage having the same polarity as that of the surface of the photosensitive body and an absolute value larger than the electric image forming potential of the transfer member is performed for a first period of time. In addition, a second step of applying a second voltage having an absolute value smaller than the absolute value of the electric potential of the surface of the photosensitive body to the transfer member for a second period of time not shorter than the first period of time is performed alternately with the first step.

15 Claims, 7 Drawing Sheets

DRIVE OF PHOTOSENSITIVE DRUM
ON
OFF

ELECTRIC POTENTIAL OF PHOTOSENSITIVE DRUM
0V
-600V
LATENT IMAGE FORMATION BY EXPOSURE

DEVELOPMENT BIAS VOLTAGE
0V
-450V

TRANSFER BIAS VOLTAGE
+1000V
0V
-1000V
IMAGE SECTION
IMAGE SECTION

DRIVE OF PHOTOSENSITIVE DRUM
ON
OFF

ELECTRIC POTENTIAL OF PHOTOSENSITIVE DRUM
0V
-600V
LATENT IMAGE FORMATION BY EXPOSURE

DEVELOPMENT BIAS VOLTAGE
0V
-450V

TRANSFER BIAS VOLTAGE
+1000V
0V
-1000V
IMAGE SECTION
IMAGE SECTION

DRIVE OF PHOTOSENSITIVE DRUM
ON
OFF

ELECTRIC POTENTIAL OF PHOTOSENSITIVE DRUM
0V
-600V

DEVELOPMENT BIAS VOLTAGE
0V
-450V

TRANSFER BIAS VOLTAGE
0V
-1000V
770ms
780ms
770ms
780ms
770ms
780ms
770ms
780ms
770ms
780ms

DRIVE OF PHOTOSENSITIVE DRUM
ON
OFF

ELECTRIC POTENTIAL OF PHOTOSENSITIVE DRUM
0V
-600V

DEVELOPMENT BIAS VOLTAGE
0V
-450V

TRANSFER BIAS VOLTAGE
0V
-1000V
100ms
670ms
770ms
780ms
770ms
780ms
770ms

DRIVE OF PHOTOSENSITIVE DRUM
ON
OFF

ELECTRIC POTENTIAL OF PHOTOSENSITIVE DRUM
0V
-600V

DEVELOPMENT BIAS VOLTAGE
0V
-450V

TRANSFER BIAS VOLTAGE
0V
-1000V

DRIVE OF PHOTOSENSITIVE DRUM
ON
OFF

ELECTRIC POTENTIAL OF PHOTOSENSITIVE DRUM
0V
-600V

DEVELOPMENT BIAS VOLTAGE
0V
-450V

TRANSFER BIAS VOLTAGE
0V
-1000V
100ms
670ms
780ms
770ms
780ms
770ms
770ms

TRANSFER MEMBER CLEANING METHOD AND IMAGE FORMING APPARATUS

BACKGROUND OF THE INVENTION

The present invention relates to electronic photographic image forming apparatuses, such as copying machines, optical printers and facsimile machines using an electrophotographic system, and also relates to a transfer member cleaning method for them.

Transfer means of a conventional electrophotographic system operates in non-contact with a photosensitive body by discharging like a corotron. In recent years, however, from the viewpoint of transfer performance, there has been an increasing use of a contact transfer system which presses a belt or a roller as a transfer member against the photosensitive body, causes a transfer material in the form of a sheet, such as recording paper, to pass through between the photosensitive body and the transfer member, and transfers a transferable toner image formed on a surface of the photosensitive body to the recording paper by the function of a transfer bias (voltage) applied to the transfer member side.

However, this contact transfer system has problems, including direct transfer of the toner on the photosensitive body to the transfer roller which occurs when a document image is larger than the size of the recording paper; and extremely soiling of the transfer roller at the time of occurrence of a jam (paper jam), and strains on the back side of recording paper supplied thereafter and a transfer failure due to a substantial shortage of transfer bias voltage.

In order to solve such problems, Japanese Patent Application Laid-Open No. 1-319078 (1989) discloses a transfer roller cleaning method based on a reversal development system using a laser or LED. FIGS. 1A–1D are a timing chart of this transfer roller cleaning method. When the recording paper passes through a transfer position, a voltage of opposite polarity to the electric potential (FIGS. 1B, 1C) of toner is applied to the transfer roller (FIG. 1D) so as to transfer the toner to the recording paper. On the other hand, when no paper is passing, the surface potential on the photosensitive body (FIG. 1B) is made lower than that when forming an image, and further a voltage that has the same polarity as the electric potential of the toner and is higher than the surface potential (FIGS. 1B, 1C) of the photosensitive body is applied to the transfer roller (FIG. 1D).

In this transfer roller cleaning method, however, when no paper is passing, a voltage of the same polarity as the electric potential of the toner is always applied to the transfer member (transfer roller). Therefore, if an image forming apparatus does not have means for eliminating charges on the photosensitive body after a transfer process, there arises a phenomenon that the surface potential of the photosensitive body becomes closer to the voltage applied to the transfer member. Such a phenomenon causes a change in the image density when forming the next image, and therefore is not desirable. On the other hand, there are variations in the charge amount of each toner particle for use in forming an image, and not a little amount of toner of opposite polarity is included. For such toner which shows the charging behavior opposite to normal behavior, there is concern that the above-mentioned transfer member (transfer roller) cleaning method may rather cause heavy soiling of the transfer member.

Besides, Japanese Patent Application Laid-Open No. 2000-122450 proposes to enhance the ability to clean the transfer roller by applying a voltage generated by superimposing an AC voltage on a DC voltage as a transfer roller cleaning voltage. However, this method also has the same concern as that of the above-mentioned Japanese Patent Application Laid-Open No. 1-319078 (1989), and generation of the AC voltage itself causes an increase in the power supply cost.

Furthermore, although it is a method of changing the potential difference between the photosensitive body surface and the transfer member, Japanese Patent Application Laid-Open No. 10-282816 (1998) proposes to perform transfer cleaning without a transfer cleaning bias voltage, namely at a low cost, by causing the transfer roller to float and changing the applied voltage of a contact charging member when performing contact transfer cleaning.

In this technique, the surface potential of the photosensitive body periodically changes, and therefore complicated control is necessary to change a development bias voltage. Since the change in the surface potential of the photosensitive body relates to the time constant of the transfer roller, if there is a change in the environment of use, the condition of the transfer roller, etc., the time constant changes, and the cycle of change of the surface potential also changes. Thus, there is a possibility of occurrence of toner adhesion to the photosensitive body. Hence, although the purpose of this control is to clean the transfer roller, the control may rather cause soiling of the transfer roller eventually. Moreover, since there is a precondition that the charging means must be of a contact type capable of eliminating charges, non-contact type charging means cannot decrease the surface potential. In other words, the electric potential cannot be increased nor decreased. Other control of AC voltage is also described, but this control itself leads to an increase in the cost and does not meet the objective to reduce the cost.

BRIEF SUMMARY OF THE INVENTION

The present invention has been made with the aim of solving the above problems, and it is a principal object of the present invention to provide a transfer member cleaning method and an image forming apparatus, capable of easily cleaning a contact transfer member at a low cost and further preventing a transfer material such as paper from being stained.

As described above, not a little amount of toner adheres to the transfer member with use. For the removal of the adhered toner from the transfer member, there are mechanical or electrical methods. However, with a mechanical cleaning method which removes the toner by bringing a blade, for example, into contact with the transfer member, it is not easy to mechanically remove the toner which resides in the foam of the transfer member and the toner which strongly adheres to the surface, and also there is a problem concerning the processing method of the removed toner. On the other hand, in an electrical cleaning method as described above, since cleaning by an electric field in a single direction corresponds to only one polarity of the toner, and thus the toner having the other polarity cannot be removed and adheres more strongly to the transfer member.

In general, toner which soils the transfer member when the size of transfer material (paper size) is not appropriate and when a jam (paper jam) occurs is toner with normal polarity, while toner which gradually soils the transfer member over a long time is toner of opposite polarity which adheres to the photosensitive body slightly. Accordingly, cleaning can be performed by application of electric field in both directions to the transfer member. Although it is preferable to always perform the cleaning by application of electric field in both directions during a period of operation in which an image formation cycle is not actually performed, such as before image formation, an interval between a transfer material (transfer paper) and a transfer material (transfer paper), after image formation, and during recovery from a jam, but this cleaning increases the operating time of the image forming apparatus and decreases the life of consumable parts and job efficiency.

Therefore, in order to increase the cleaning effect at most without causing troubles by adopting this cleaning method, it is preferable to perform cleaning during a non-printing operation such as in turning power on, power shut off recovery, and recovery after occurrence of an error such as a jam. Moreover, since the amount of toner with normal polarity is much larger, it is preferable to first apply a high voltage to the transfer member to move the toner with normal polarity from the transfer member to the photosensitive body, and then provide a period for applying a low voltage for moving the toner with opposite polarity.

Next, it is necessary to consider the influence of the cleaning of the transfer member on the surface potential of the photosensitive body. If charge eliminating means is provided on the upstream side of the charging means, there should be no problem. However, many image forming apparatuses do not include charge eliminating means for a reduction in the costs. Furthermore, if the charging member is of contact type, charge eliminating performance can be expected, but a scorotron type charging member can not decrease the electric potential though it can increase the electric potential.

Thus, in an image forming apparatus without charge eliminating means, when a high voltage of the same polarity as the surface potential of the photosensitive body is applied to the transfer member, the surface potential of the photosensitive body becomes higher than the grid potential of the scorotron, and finally converges to a high electric potential applied to the transfer member. Consequently, the adhesion of toner to the non-image section of the photosensitive body increases, and there is a problem of carrier adhesion in the case of two-component reversal development. In other words, in an image forming apparatus that has a non-contact charging member such as a scorotron but does not have charge eliminating means, it is essential to limit an increase in the surface potential of the photosensitive body when performing the cleaning of the transfer member.

Then, in order to provide the transfer member with both the charging and charge eliminating functions, the present invention proposes to limit an increase in the surface potential of the photosensitive body.

The surface potential of the photosensitive body increases in each cycle of driving the photosensitive body by application of a high voltage which has the same polarity as and higher than the surface potential of the photosensitive body applied to the transfer member. Therefore, by limiting a single high voltage application period to the transfer member within one driving cycle of the photosensitive body, the increase in the electric potential is limited to about 5% or so. With such a degree of electric potential variation, the above-mentioned adhesion of toner and carrier is not considered as a problem.

Next, when performing the charge eliminating function, it is necessary to perform charge elimination for at least one driving cycle of the photosensitive body because it is uncertain how much area in one turn of the photosensitive body has an increase in the electric potential. Of course, a low voltage is applied to the transfer member for the charge elimination, and the absolute value of this low voltage needs to be smaller than that of the surface potential of the photosensitive body. In other words, there are preconditions that the period of charging the photosensitive body by applying a high voltage to the transfer member must not be more than one driving cycle of the photosensitive body, and the period of eliminating charges on the photosensitive body by applying a low voltage to the transfer member must not be less than one driving cycle of the photosensitive body. However, considering the cleaning performance and the driving time, it is preferable that the high voltage application period to the transfer member should not be more than one driving cycle of the photosensitive body but should be as close as one driving cycle, and the low voltage application period to the transfer member should not be less than one driving cycle of the photosensitive body but should be as close as one driving cycle.

Here, the applied voltage to the transfer member is closely related to the cleaning performance and the charge elimination performance. In the high voltage application, namely, cleaning of the toner with normal polarity, needless to say, the absolute value of the high voltage is larger than the surface potential of the photosensitive body, but too small potential difference causes a problem in the cleaning performance, whereas too large potential difference causes a problem such as a leakage to the photosensitive body. It is thus necessary to determine an optimum voltage. On the other hand, for the low voltage, the same principle as that for charging can be applied. In order to perform charge elimination and remove the toner with opposite polarity, an appropriate low voltage to be applied to the transfer member is around a voltage given by multiplying the surface potential of the photosensitive body by two and subtracting the above-mentioned high voltage from the result. From the above, as the cleaning voltage applied to the transfer member, for example, if the surface potential of the photosensitive body is −600 V, for example, −1000V high voltage and −2000V low voltage are preferably applied alternately. More simply, if the low voltage is made 0 V, the same effects can be obtained by switching on/off the application of −1000 V.

Another function of the present invention is to make the transfer member hard to be soiled, instead of cleaning the transfer member. For example, the toner which soils the transfer member during a jam in which the transfer material (transfer paper) is not normally transported is toner with normal polarity, and there is a possibility that a large amount of toner adheres to the transfer member. With conventional techniques, it is difficult to quickly and perfectly clean the large amount of toner that has once adhered. In such a case, since the toner has normal charge polarity, it is possible to cause the toner to repel by application of a voltage of the same polarity as the toner to the transfer member, and thereby decrease the soiling of the transfer member as less as possible.

When starting recovery from the jam, first, a high voltage is applied, and then the above-mentioned low voltage application and high voltage application are repeated alternately. The greater the number of times of repetition of high voltage and low voltage application, the higher the cleaning effect. However, an increase in the driving time due to such repetition is not favorable for the durability of consumable parts and the standby time. Accordingly, cleaning performance which does not lead to problems in use can be obtained by repeating the application at least three times or so.

As described above, the present invention provides a low-cost and simple transfer member cleaning method and an image forming apparatus by taking into consideration the following: preventing toner adhesion to the photosensitive body and also carrier adhesion in the case of two-component developer by limiting the change in the surface potential of the photosensitive body; ensuring cleaning performance for toner showing a normal charging behavior and also toner showing the opposite charging behavior; reducing the change in the cleaning ability depending on the environment and condition of use; and making it hard to receive toner stains on the photosensitive body.

According to the present invention, an image is formed by charging the surface of the photosensitive body being driven and then exposing the surface to light to form an electrostatic latent image, developing the electrostatic latent image with toner having the same polarity as the charge polarity of the surface of the photosensitive body to form a toner image, and transferring the toner image from the photosensitive body to a transfer material by driving the photosensitive body and a roller or belt-shaped transfer member while pressing the transfer material. The transfer member is cleaned by applying a first voltage which has the same polarity as an electric potential to which the surface of the photosensitive body is charged and an absolute value larger than the electric potential to the transfer member for a first period of time when image formation is not performed, and applying a second voltage having an absolute value smaller than the absolute value of the electric potential to which the surface of the photosensitive body is charged to the transfer member for a second period of time, which is not shorter than the first period of time, when image formation is not performed.

In this case, it is preferable to set the first period of time shorter than one driving cycle of the photosensitive body and set the second period of time longer than one driving cycle of the photosensitive body. It is also preferable to repeat the process of applying the first voltage for the first period of time and the process of applying the second voltage for the second period of time alternately a plurality of times. In this way, cleaning of the transfer member is performed more effectively.

Additionally, in the present invention, it is preferable to apply the first voltage to the transfer member for a period of time not less than one driving cycle of the transfer member at the time of or before starting to drive the photosensitive body, and thereafter set the first period of time not to be less than a time taken for a position of the charged photosensitive body to reach the transfer member after charging of the photosensitive body. Accordingly, by moving the toner adhering to the surface of the transfer member to the surface of the photosensitive body at least once, it is possible to substantially uniformly clean the entire area of the surface of the transfer member and prevent adhesion of the toner residing on the surface of the photosensitive body to the transfer member, which would occur at start of driving after occurrence of a jam or other error.

Besides, in the present invention, it is preferable that the absolute value of the first voltage is not more than 1500 V and is 300 V or more larger than the absolute value of an electric potential to which the surface of the photosensitive body is charged, and the second voltage is substantially equal to a voltage given by multiplying the electric potential to which the surface of the photosensitive body is charged by two and subtracting the first voltage from the result. Accordingly, in the transfer member cleaning control process, it is possible to clean the toner with normal polarity when the absolute value of the high voltage applied to the transfer member is larger than the surface potential of the photosensitive body, clean toner with opposite polarity in the case of low voltage, and also eliminate charges on the surface of the photosensitive body to stabilize the surface potential of the photosensitive body.

Furthermore, in the present invention, since the surface of the photosensitive body is charged in a non-contact manner, charge eliminating means is omitted. It is thus possible to clean the transfer member effectively while limiting an increase in the surface potential of the photosensitive body.

The above and further objects and features of the invention will more fully be apparent from the following detailed description with accompanying drawings.

DETAILED DESCRIPTION OF THE INVENTION

The following description will explain the present invention in detail, based on the drawings illustrating an embodiment thereof.

Figures 1A, 1B, 1C, 1D:
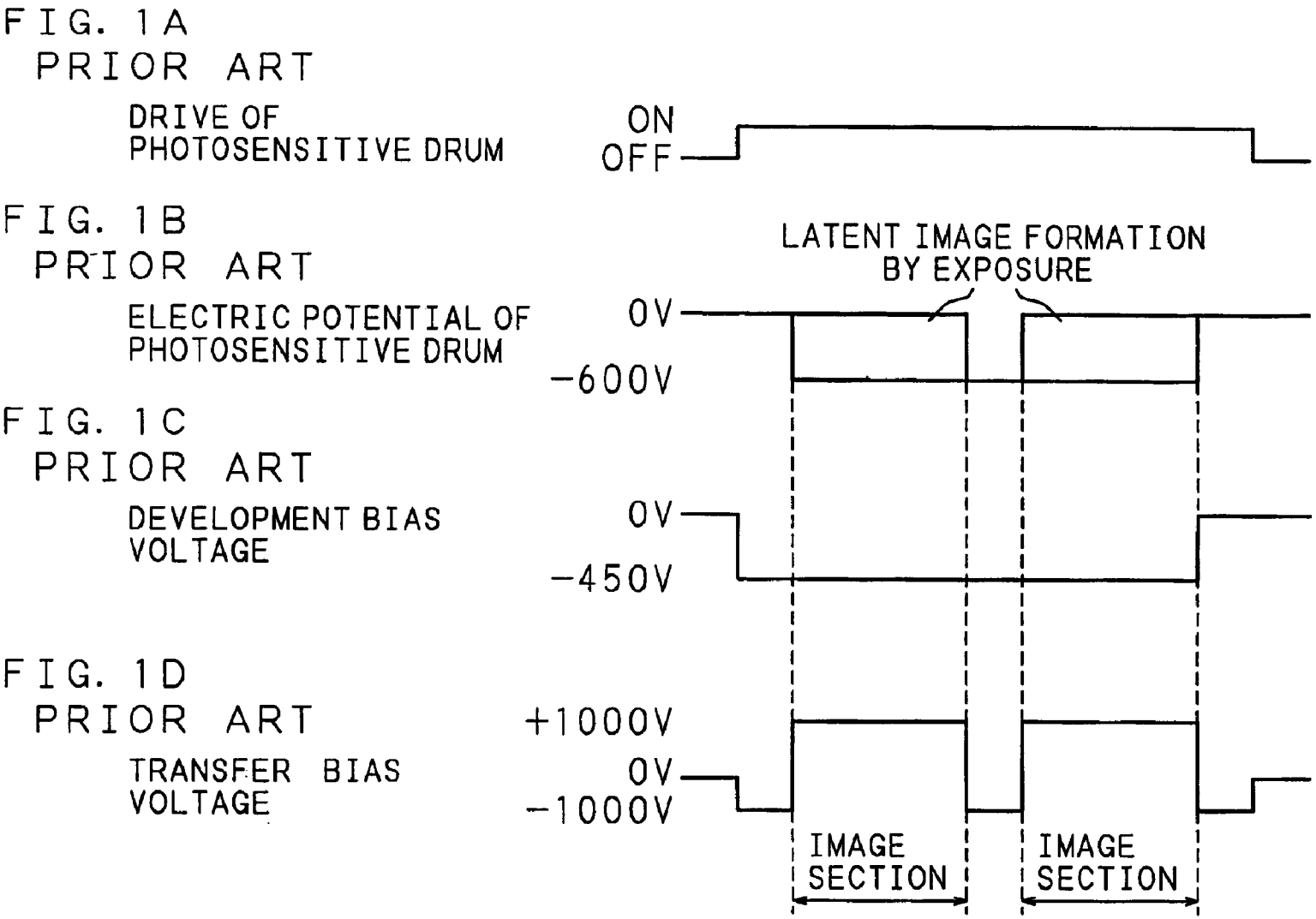
FIG. 1A PRIOR ART
FIG. 1B PRIOR ART
FIG. 1C PRIOR ART
FIG. 1D PRIOR ART
FIGS. 1A–1D are a timing chart showing the relationship among driving of the photosensitive drum, the electric potential of the photosensitive drum, a development bias voltage and a transfer bias voltage in a printing operation (of an image forming apparatus of a conventional example) performed without control of repetition of high voltage application and low voltage application for cleaning a transfer member.
Figure 2:
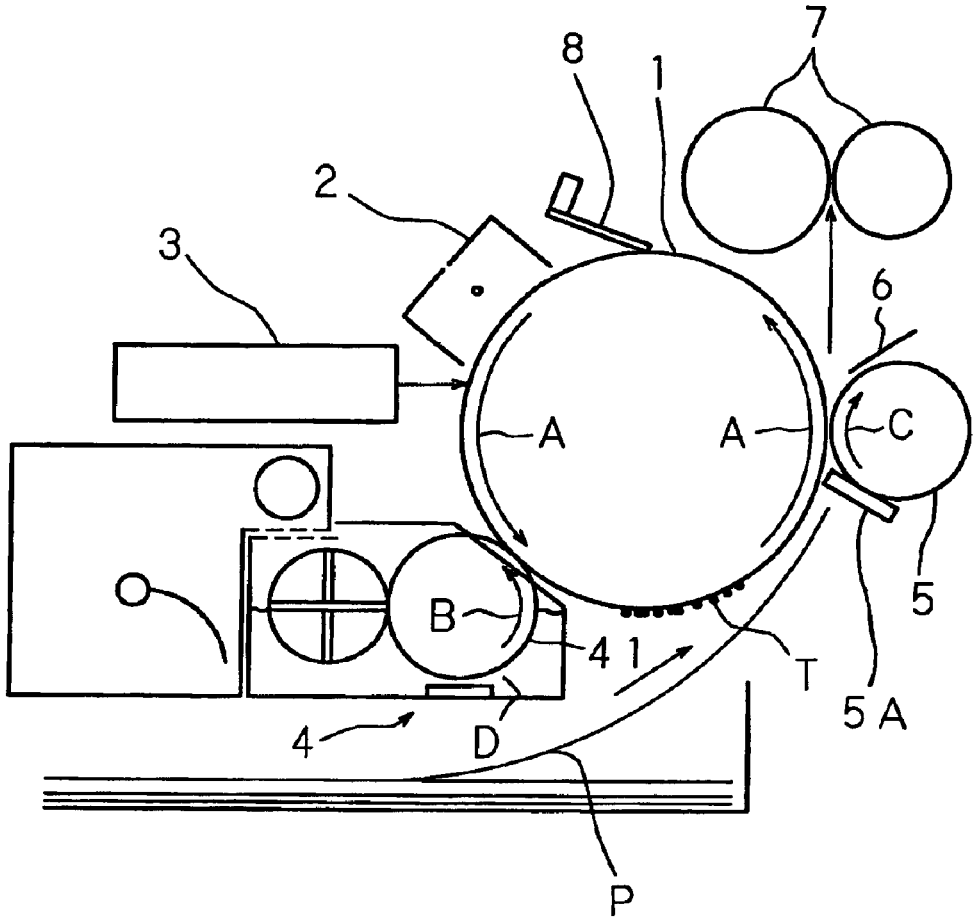
FIG. 2 is a schematic view showing the configuration of essential parts of an image forming apparatus of the present invention.

FIG. 2 is a schematic view showing the configuration of essential parts of an image forming apparatus of the present invention. This image forming apparatus comprises a charging device 2, an exposure device 3, a developer device 4, a transfer member 5, a separating member 6, and a cleaning blade 8 which are arranged in this order around the periphery of a cylindrical photosensitive drum 1 (photosensitive body). A paper transport path for transporting paper P as a transfer material is provided between the photosensitive drum 1 and the transfer member 5, and fixing rollers 7 are disposed on the downstream side of the transfer member 5 in the paper transport path.

The photosensitive drum 1 comprises a conductive base made of metal or plastic, an under-coat layer formed on the surface of the conductive base, and a photosensitive layer formed on the under-coat layer. The photosensitive layer comprises a relatively thin carrier generation layer (CGL) formed on the under-coat layer, and a carrier transport layer (CTL) composed mainly of polycarbonate and formed as an outermost layer. The photosensitive drum 1 has a diameter of 30 mm and is disposed so that it can rotate in the direction of arrow A. The surface of the photosensitive drum 1 is uniformly charged to a predetermined charge amount (substantially −60 V) by a scorotron charger using a corona charger that is the charging device 2, and carries an electrostatic latent image by forming a predetermined electrostatic latent image potential by the exposure device 3. In the photosensitive drum 1, carriers are generated in the carrier generation layer by exposure to light from the exposure device 3, and the charges on the surface of the photosensitive drum 1 are cancelled out by the carriers moved in the CTL. An area irradiated by optical information irradiation by exposure is attenuated to substantially −100 V, and this attenuated section forms an electrostatic latent image.

With a rotation of the photosensitive drum 1, the electrostatic latent image formed on the surface of the photosensitive drum 1 is transported to a development area where it comes into contact with developer D adhering onto a developer carrying body 41 of the developer device 4. The developer carrying body 41, which rotates in the direction of arrow B that is opposite to the direction of arrow A in which the photosensitive drum 1 rotates, is pressed against the photosensitive drum 1. However, the rotation direction of the developer carrying body 41 is not necessarily limited to the direction of arrow B. Toner T in the developer D carried on the developer carrying body 41 moves and adheres according to the electrostatic latent image on the photosensitive drum 1, thereby visualizing and developing the electrostatic latent image. A predetermined bias voltage is applied from the power supply (not shown) to the developer carrying body 41, and the toner charged to a negative polarity adheres to the above-mentioned section with attenuated electric potential and forms a toner image by the reversal development system.

After the developing process in the developer device 4, the toner T adhering to the photosensitive drum 1 is transported to a predetermined transfer area. In the transfer area, paper P as a transfer material has been supplied by supply means (not shown) in synchronism with the toner image on the photosensitive drum 1, and comes into contact with the toner image on the photosensitive drum 1.

The transfer member 5 disposed in the transfer area is a contact transfer roller with switchable high voltage power supply 5*a* (or first and second alternatively operating voltage applying units (not shown), if desired) that is supplied with a voltage of the polarity of the side to which the toner T is to be transferred. Consequently, the toner T moves to the paper P, and the toner image is transferred. However, the transfer member 5 is not necessarily limited to a contact trasfer roller, and can be in other form such as a belt. Morever, the peripheral velocity of the contract transfer roller is set to be 1.03 times the peripheral velocity of the photosensitive drum 1 with a drive force from the photosensitve drum 1 side. The tranfer roller of the transfer member 5 is 14.3 mm in diameter and 301 mm in diameter and 301 mm in the roller's resilient body length, and pressed to form a nip (contact section) of about 2.5 mm in the circumferential direction of the photosensitive drum 1. By using a roller showing a medium resistance of about $1\times10^{7}$ to $1\times10^{11}\Omega$cm as the resistivity, the transfer roller can satisfactorily transfer the toner T on the photosensitive drum 1 to the paper P. Note that the roller's resilient body uses a solid rubber, such as EPDM (foam rubber), NBR (nitrile butadiene rubber) and urethane rubber, in which conductive carbon is dispersed.

After separating the paper P from the photosensitive drum 1 by the separating member 6, the toner T on the paper P is fixed by the fixing rollers 7 by heat fusion or pressure, for example. Thereafter, the paper P is discharged out of the apparatus, while the surface of the photosensitive drum 1 after the transfer process is cleaned by the cleaning blade 8.

In the above-described image forming apparatus, by taking the optical response of the photosensitive drum 1 and the development performance into consideration, setting values are determined as shown below.

| | |
|---|---|
| Linear velocity of developer carrying body | 366 mm/s |
| Linear velocity of photosensitive drum | 122 mm/s |
| Print speed (A4) | 27 CPM |
| Resolution | 600 dpi |
| Laser power | 0.40 mW |
| Charge potential | −600 V |
| Development bias voltage | −450 V |
| Transfer cleaning voltage | −1000 V |
| Transfer voltage | 1000 V |

Figures 3A, 3B, 3C, 3D:
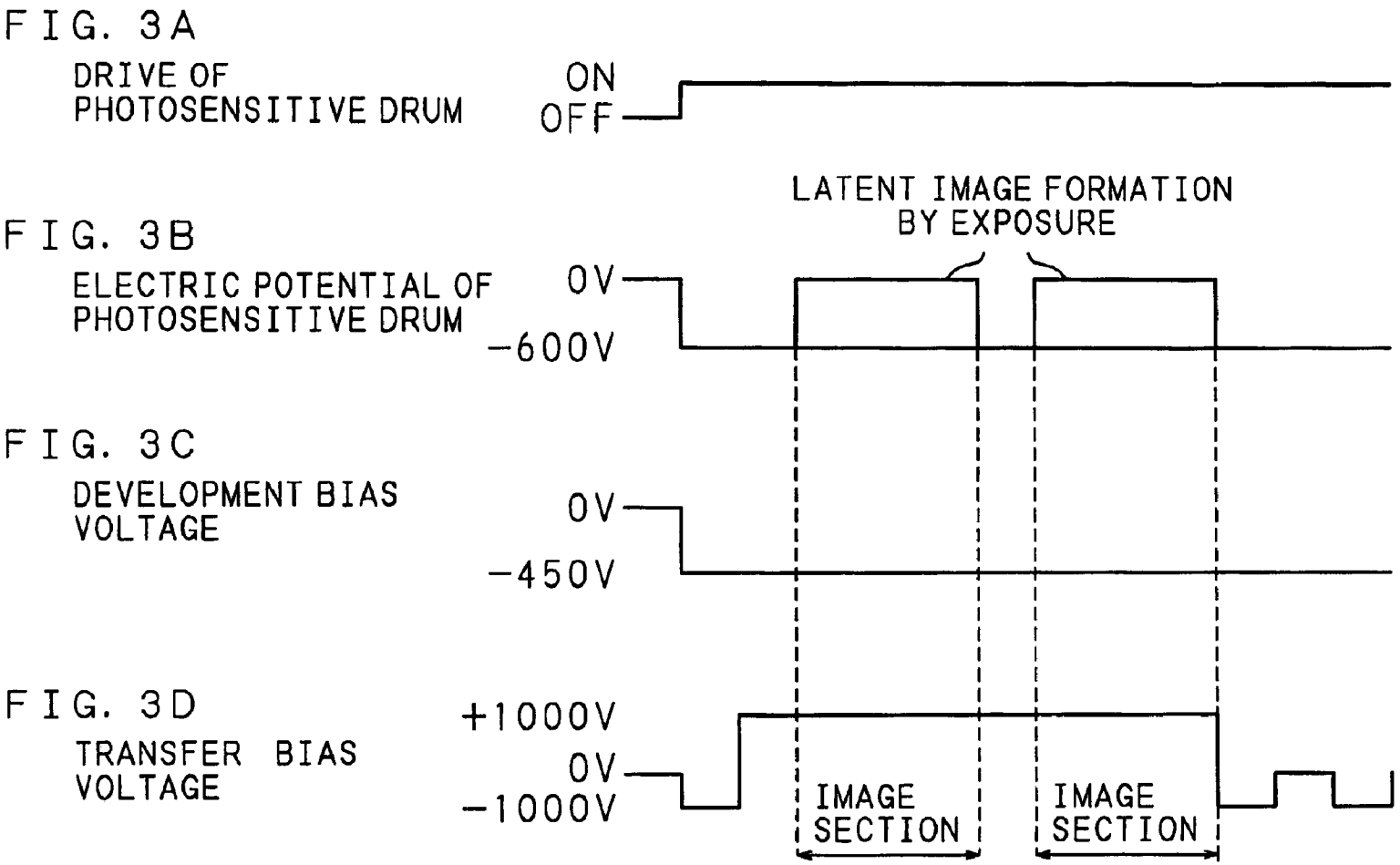
FIGS. 3A–3D are a timing chart showing the relationship among driving of the photosensitive drum, the electric potential of the photosensitive drum, a development bias voltage and a transfer bias voltage in a printing operation of the image forming apparatus of the present invention.
Figures 4A, 4B, 4C, 4D:
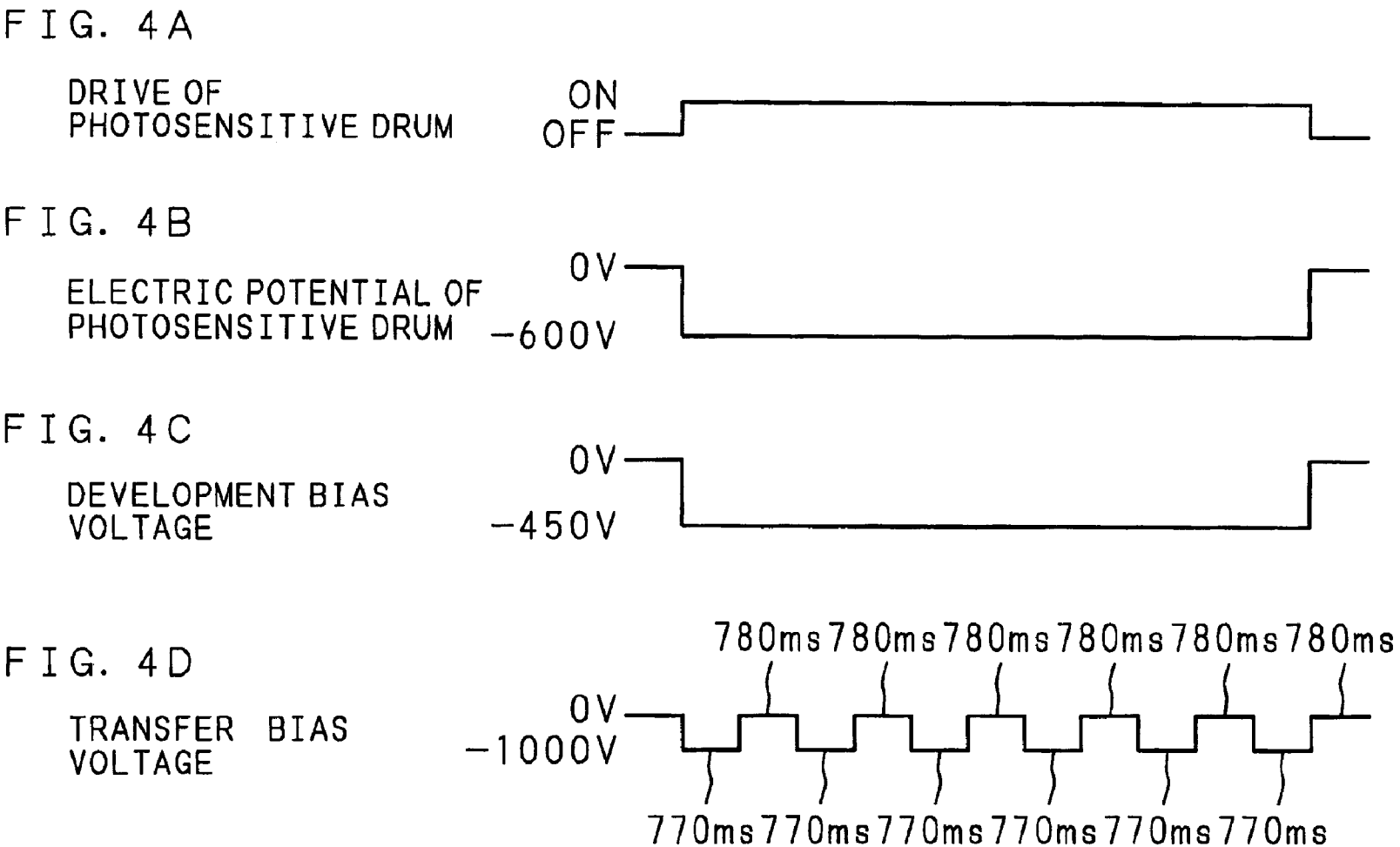
FIGS. 4A–4D are a timing chart showing the relationship among driving of the photosensitive drum, the electric potential of the photosensitive drum, a development bias voltage and a transfer bias voltage in a non-printing operation of the image forming apparatus of the present invention (operation when turning on power and opening/closing a cover)
Figures 5A, 5B, 5C, 5D:
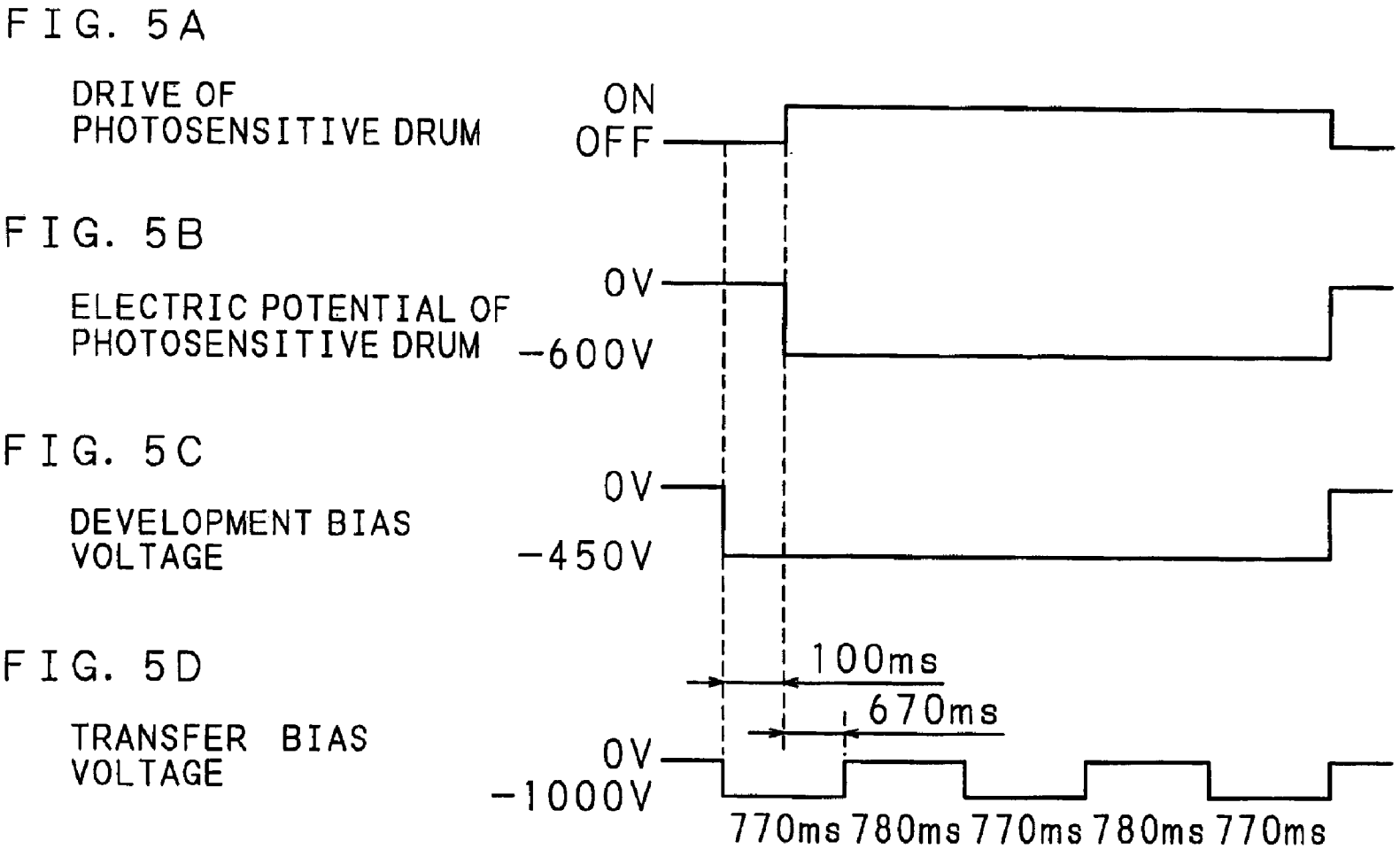
FIGS. 5A–5D are a timing chart showing the relationship among driving of the photosensitive drum, the electric potential of the photosensitive drum, a development bias voltage and a transfer bias voltage in a non-printing operation of the image forming apparatus of the present invention (recovery operation after a halt due to an error such as a jam)

FIGS. 3A–3D are a timing chart in a printing operation of the image forming apparatus of the present invention. With the start of driving the photosensitive drum 1 (FIG. 3A), the photosensitive drum 1 is charged by the charging device 2 (FIG. 3B), and a development bias voltage is applied (FIG. 3C). Thereafter, a latent image is formed on the photosensitive drum 1 by the exposure device 3 (FIG. 3B), and visualized into a toner image by the developer device 4. The visualized toner image is transferred to paper P by the transfer member 5, and then the paper P is discharged through the separation step and fixing step.

In this series of steps, first, after starting to drive the photosensitive drum 1, a constant voltage of −1000 V having the same polarity as the toner T is applied as a cleaning bias voltage to the transfer member 5 so as to cause a repulsion of the toner T onto the photosensitive drum 1 (FIG. 3D). Next, the voltage is switched to a constant voltage of +1000 V (FIG. 3D) to attract toner with normal polarity, which was not removed by the above-mentioned cleaning bias voltage, to the transfer member 5 and repel toner with opposite polarity. Thereafter, as described above, the photosensitive drum 1 carrying the visualized toner image thereon and the paper P are synchronized, and the toner T on the photosensitive drum 1 is transferred to the paper P by the constant voltage of +1000 V.

After completing a series of transfer to the paper P, application of high voltage of −1000 V (absolute value) and application of low voltage of 0 V to the transfer member 5 are repeated (FIG. 3D), cleaning of the transfer member 5 is performed, and then the surface potential of the photosensitive drum 1 and the development bias voltage are decreased to end the driving of the drum. According to this series of operation, it is possible to achieve printing with satisfactory transfer performance, without making stains on the paper P.

FIGS. 4A–4D are a timing chart showing operations when turning on power or opening/closing a cover in a non-printing operation of the image forming apparatus of the present invention. The operation when starting and ending the driving of the photosensitive drum 1 are based on the above-described printing operation (FIGS. 3A–3D), but the application of high voltage of −1000 V and application of low voltage of 0 V as a cleaning voltage (FIG. 4D) are repeated to control the transfer member 5 during this operation.

In order to limit an increase in the surface potential of the photosensitive drum 1, the high voltage application period is set to 770 msec which is less than the rotation cycle (773 msec) of the photosensitive drum 1, and the low voltage application period is set to 780 msec. With these time settings, the variation in the surface potential of the photosensitive drum 1 is limited to 20 V or so. Since 770 msec which is more than the rotation cycle (736 msec) of the transfer roller of the transfer member 5 is secured for the high voltage application period, it is possible to obtain satisfactory printing without causing stains on the paper P in the subsequent printing operation.

FIGS. 5A–5D are a timing chart showing a recovery operation after a halt due to an error, such as a jam (paper jam), in a non-printing operation of the image forming apparatus of the present invention. At the time of a halt due to an error, there is a high possibility that toner T adheres to the surface of the photosensitive drum 1, and the photosensitive drum 1 is stopped with a high surface potential. Then, in order to prevent adhesion of carriers in the developer D during the next driving of the photosensitive drum 1 (FIG. 5A), first, it is necessary to raise the development bias voltage before starting to drive the photosensitive drum 1. If the surface potential of the photosensitive drum 1 is attenuated by dark attenuation, there is a possibility that the toner T adheres to the entire area of the surface of the photosensitive drum 1.

In order to prevent soiling of the transfer roller by the toner T, 100 msec before starting to drive the photosensitive drum 1, −1000 V is applied in advance as the transfer cleaning voltage to the transfer member 5 (FIG. 5D) so as to repel the toner T on the surface of the photosensitive drum 1. Next, the driving of the photosensitive drum 1 is started (FIG. 5A), and the application of high voltage of −1000 V and application of low voltage of 0 V as the cleaning voltage are repeated (FIG. 5D) in the same manner as in FIG. 4D.

Note that although the first cleaning high voltage application period is 770 msec, 670 msec in this period is secured for the application period after the start of driving. Since this is longer than the time (516 msec) taken for the charged position of the photosensitive drum 1 to reach the transfer position, a time necessary to cause a repulsion of the toner T adhering to the surface of the photosensitive drum 1 at the time of rising is ensured. With the above-mentioned control, it is possible to obtain satisfactory printing without causing stains on the paper P in the printing operation after recovering from a halt due to an error.

Based on the timing charts as described above, aging tests were performed for 50000 sheets with an intermittence of 3 sheets under three environments, namely, low-temperature and low-humidity, ordinary-temperature and ordinary-humidity, and high-temperature and high-humidity conditions. As a result, even after aging, it was possible to obtain satisfactory printing without stains on the back side of the recording paper in the above-mentioned operation.

According to the recovery timing chart after a halt due to an error such as a jam in the above-described embodiment, by changing the cleaning voltage of −1000 V (FIG. 5D), confirmation was performed for stains made on the paper during printing after recovery. It was found that stains became worse with a decrease in the voltage absolute value, and thus it was necessary to apply a voltage of at least −900 V. On the contrary, when the voltage absolute value was increased, a local leakage from the transfer member 5 to the photosensitive drum 1 occurred, and consequently a pinhole defect occurred in the photosensitive drum 1 and black dots/white dots appeared on the subsequent prints. It was thus necessary to limit the upper limit of the application voltage absolute value to 1500 V.

Moreover, according to the recovery timing chart after a halt due to an error such as a jam in the above-described embodiment, a jam was caused using A4-sized recording paper during entirely black solid printing, and then confirmation was performed for stains on the recording paper just after recovery from the jam. As a result, it was found that, in order to prevent the back side from being stained in printing just after recovery, as the application period of 770 msec of −1000 V cleaning high voltage (FIG. 5D) during recovery was shortened, it was necessary to increase the number of times of application. In other words, it was found that the total time of application of −1000 V was one condition for the cleaning of the transfer member 5.

In contrast, when the cleaning low voltage application period was extended from 780 msec, no indirect influence on the stains on the back side was recognized, but the recovery time was increased by the period of the extended time. In short, it was found that the shortening of the cleaning high voltage application period and the extension of the low voltage application period not only cause a decrease in the cleaning performance for the transfer member 5, but also cause eventually an increase in the recovery time after a halt due to an error.

FIGS. 1A–1D are a timing chart showing a printing operation without control of repetition of the high voltage application and low voltage application for cleaning the transfer member 5 in the above-described embodiment. With the operations according to the timing chart, aging tests were performed for 50000 sheets in the same manner as above. As a result, stains on the back side of paper due to accumulated soiling of the transfer member, particularly stains under the high-temperature and high-humidity condition, were noticeable.

Figures 6A, 6B, 6C, 6D:
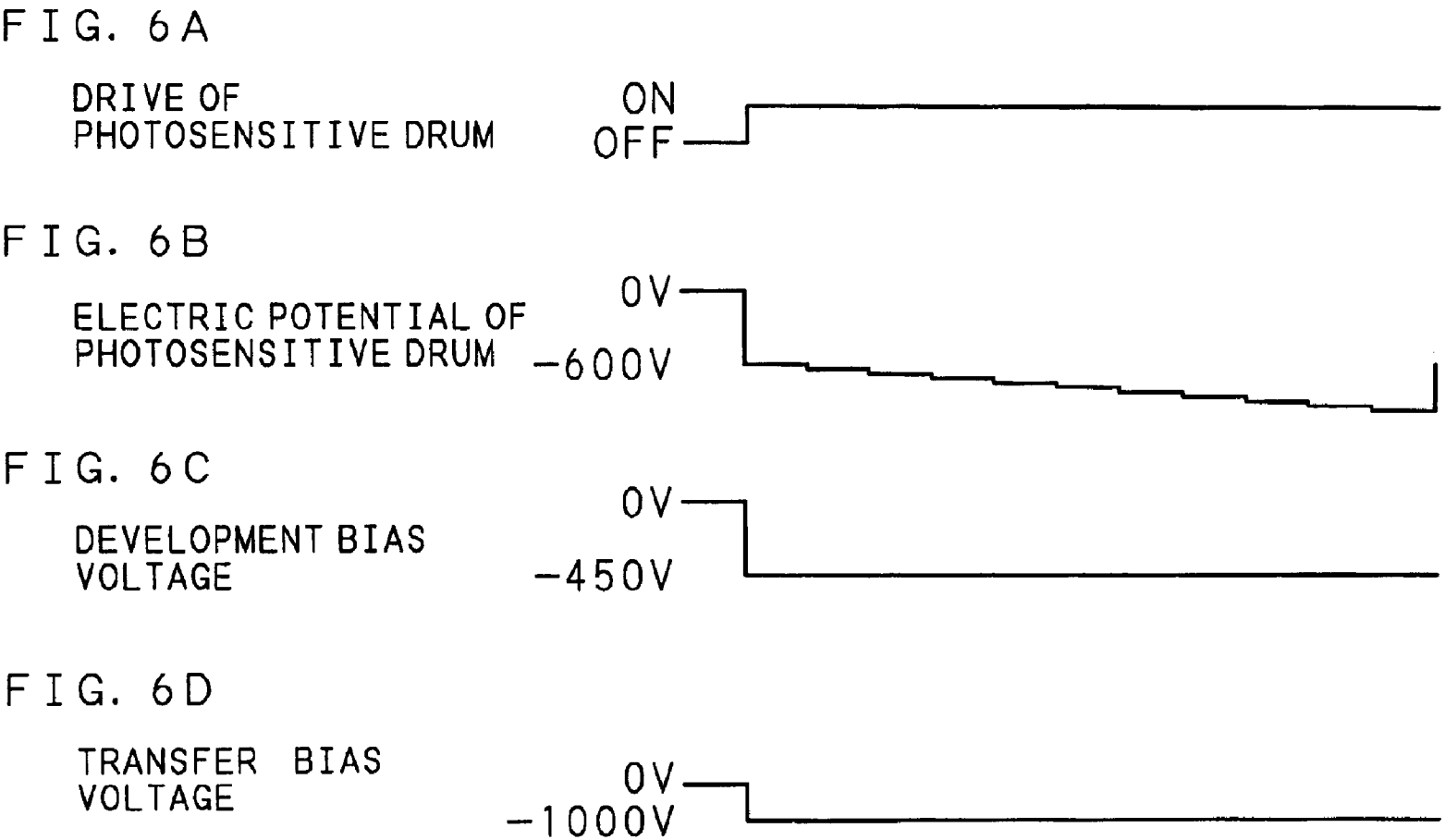
FIGS. 6A–6D are a timing chart showing the relationship among driving of the photosensitive drum, the electric potential of the photosensitive drum, a development bias voltage and a transfer bias voltage when turning on power, without performing control of repetition of high voltage application and low voltage application for cleaning the transfer member.
Figures 7A, 7B, 7C, 7D:
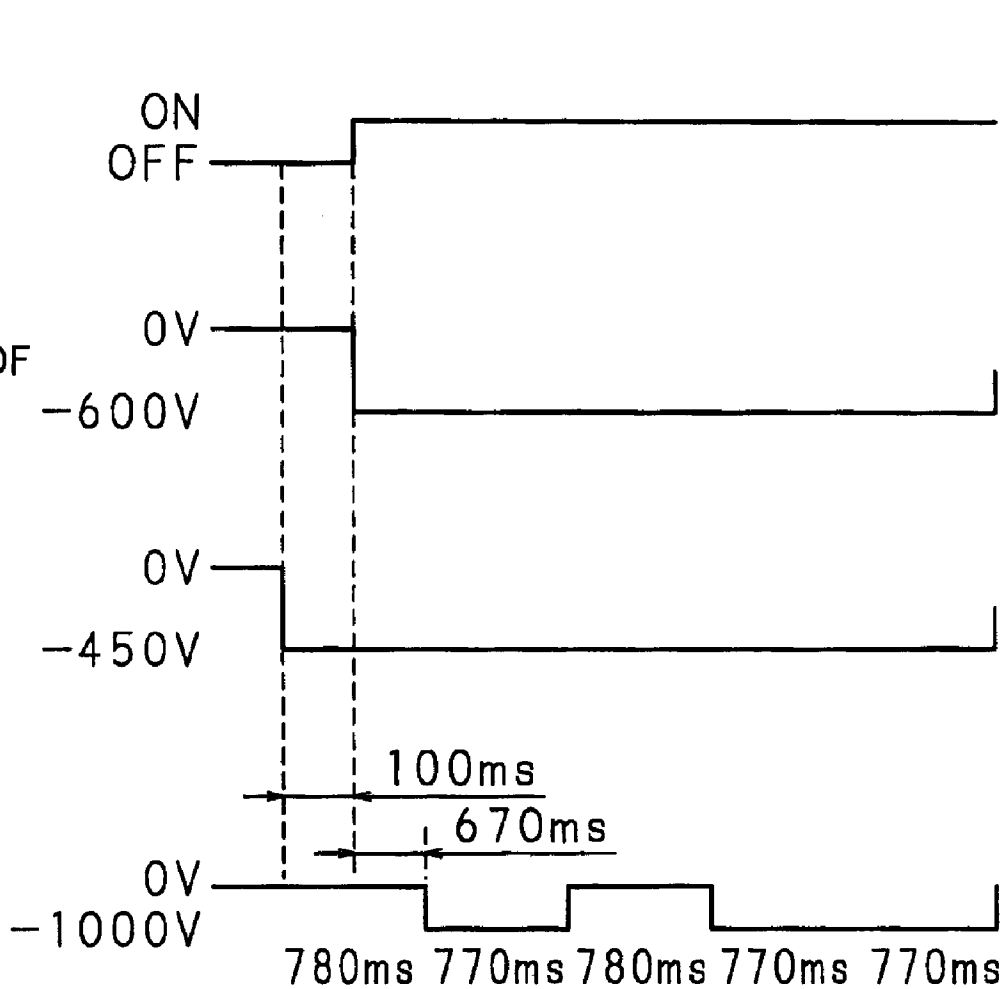
FIGS. 7A–7D are a timing chart showing the relationship among driving of the photosensitive drum, the electric potential of the photosensitive drum, a development bias voltage and a transfer bias voltage in an operation when applying a low voltage first as a transfer member cleaning voltage at start of driving in recovering from an error such as a jam.

FIGS. 6A–6D are a timing chart showing an operation performed when turning on power, without control of repetition of high voltage application and low voltage application for cleaning the transfer member 5 in the above-described embodiment. With the cleaning voltage for the transfer member 5 (FIG. 6D), the electric potential of the photosensitive drum 1 is periodically increased (the absolute value is increased), and finally converges to −1000 V which is the cleaning voltage for the transfer member 5 (FIG. 6B). When the surface potential (absolute value) of the photosensitive drum 1 is increased in such a manner, the adhesion amount of toner is rather increased, and the paper is stained in the next printing operation and also carrier adhesion occurs in the case of two-component developer. This increase in the electric potential is particularly noticeable under the high-temperature and high-humidity condition, and is not acceptable at all in actual use.

FIGS. 7A–7D are a timing chart showing an operation performed when first applying a low voltage as a cleaning voltage to the transfer member 5 at start of driving when recovering from an error such as a jam in the above-described embodiment. In this case, the transfer member 5 cannot repel the toner T on the surface of the photosensitive drum 1 during the driving for recovery, and then stains appear on the back side of the recording paper in the next printing operation.

As described above, according to the present invention, it is possible to realize a transfer member cleaning method and an image forming apparatus, capable of effectively cleaning the transfer member while limiting an increase in the surface potential of the photosensitive body. Moreover, by moving the toner adhering to the surface of the transfer member at least once to the surface of the photosensitive body, it is possible to substantially uniformly clean the entire surface of the transfer member and also prevent adhesion of the toner residing on the surface of the photosensitive body to the transfer member, which will occur at start of driving after occurrence of a jam or other error. Furthermore, in the transfer member cleaning control step, it is possible to clean toner with normal polarity when the absolute value of high voltage applied to the transfer member is larger than the surface potential of the photosensitive body, clean toner with opposite polarity in the case of low voltage, and also eliminate charges on the surface of the photosensitive body to stabilize the surface potential of the photosensitive body.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A transfer member cleaning method for an image forming apparatus, which forms an image by charging a surface of a photosensitive body being driven and then exposing the surface to light to form an electrostatic latent image, developing the electrostatic latent image with toner having same polarity as a charge polarity of the surface of the photosensitive body to form a toner image, and transferring the toner image from the photosensitive body to a transfer material by driving the photosensitive body and a roller or belt-shaped transfer member while pressing the transfer material, comprising:

a first step of applying a first voltage having same polarity as an electric potential to which the surface of the photosensitive body is charged and an absolute value larger than the electric potential to the transfer member for a first period of time in a time interval when image formation is not performed; and a second step of applying a second voltage having an absolute value smaller than the absolute value of the electric potential to which the surface of the photosensitive body is charged to the transfer member for a second period of time, in said time interval when image formation is not performed;

wherein the first step and the second step are repeated alternately a plurality of times during said time interval.

2. The transfer member cleaning method of claim 1, wherein the first voltage is applied to the transfer member for a period of time not less than one driving cycle of the transfer member on or before starting to drive the photosensitive body when image formation is not performed, and thereafter the first period of time is set to be not less than a period of time taken for a position of the charged photosensitive body to reach the transfer member after charging of the photosensitive body.

3. The transfer member cleaning method of claim 1, wherein the absolute value of the first voltage is not more than 1500 V and is 300 V or more larger than the absolute value of the electric potential to which the surface of the photosensitive body is charged, and the second voltage is substantially equal to a voltage given by multiplying the electric potential to which the surface of the photosensitive body is charged by two and subtracting the first voltage from the result.

4. The transfer member cleaning method of claim 1, wherein the surface of the photosensitive body is charged in a non-contact manner, and a process for charge elimination is omitted.

5. An image forming apparatus for forming an image by charging a surface of a photosensitive body being driven and then exposing the surface to light to form an electrostatic latent image, developing the electrostatic latent with toner having same polarity as a charge polarity of the surface of the photosensitive body to form a toner image, and transferring the toner image from the photosensitive body to a transfer material by driving the photosensitive body and a roller or belt-shaped transfer member while pressing the transfer material, comprising:

voltage application means for applying a first voltage having same polarity as an electric potential to which the surface of the photosensitive body is charged and an absolute value larger than the electric potential to the transfer member for a first period of time in a time interval when image formation is not performed, and for wherein the transfer member is cleaned by the first voltage and the second voltage applied by the voltage application means; and, wherein the application of the first voltage and the second voltage by the voltage application means is repeated alternately a plurality of times in said time interval.

6. The image forming apparatus of claim 5, wherein the first voltage is applied by the voltage application means to the transfer member for a period of time not less than one driving cycle of the transfer member on or before starting to drive the photosensitive body, and thereafter the first period of time is set to be not less than a period of time taken for a position of the charged photosensitive body to reach the transfer member after charging of the photosensitive body.

7. The image forming apparatus of claim 5, wherein the absolute value of the first voltage is not more than 1500 V and is 300 V or more larger than the absolute value of the electric potential to which the surface of the photosensitive body is charged, and the second voltage is substantially equal to a voltage given by multiplying the electric potential to which the surface of the photosensitive body is charged by two and subtracting the first voltage from the result.

8. The image forming apparatus of claim 5, further comprising a charger for charging the surface of the photosensitve body in a non-contact manner.

9. An image forming apparatus comprising:

a photosensitive body;

a charging device for charging a surface of the photosensitive body being driven;

an exposure device for exposing the surface of the photosensitive body to light to form an electrostatic latent image;

a developer device for developing the electrostatic latent image with toner having same polarity as a charge polarity of the surface of the photosensitive body to form a toner image;

a roller or belt-shaped transfer member for transferring the toner image from the photosensitive body to a transfer material by pressing the transfer material between the photosensitive body and the transfer member; and voltage applying means for applying a first voltage having same polarity as an electric potential to which the surface of the photosensitve body is charged and an absolute value larger than the electric potential to the transfer member for a first period of time in a time interval when image formation is not performed; and a second voltage having an absolute value smaller than the absolute value of the electric potential to which the surface of the photosensitve body is charged to the transfer member for a second period of time, which is not shorter than the first period of time, in said time interval when image formation is not performed;

wherein the first voltage and the second voltage applied by the voltage application means repeat their operations alternately in said time interval a plurality of times.

10. The image forming apparatus of claim 9, wherein the first voltage applying unit applies the first voltage to the transfer member for a period of time not less than one driving cycle of the transfer member on or before starting to drive the photosensitive body, and thereafter the first period of time is set to be not less than a period of time taken for a position of the charged photosensitive body to reach the transfer member after charging of the photosensitive body.

11. The image forming apparatus of claim 9, wherein the absolute value of the first voltage is not more than 1500 V and is 300 V or more larger than the absolute value of the electric potential to which the surface of the photosensitive body is charged, and the second voltage is substantially equal to a voltage given by multiplying the electric potential to which the surface of the photosensitive body is charged by two and subtracting the first voltage from the result.

12. The image forming apparatus of claim 9, wherein the charger device charges the surface of the photosensitive body in a non-contact manner.

13. A transfer member cleaning method for an image forming apparatus, which forms an image by charging a surface of a photosensitive body being driven and then exposing the surface to light to form an electrostatic latent image, developing the electrostatic latent image with toner having same polarity as a charge polarity of the surface of the photosensitive body to form a toner image, and transferring the toner image from the photosensitive body and a roller or belt-shaped transfer member while pressing the transfer material, comprising:

a first step of applying a first voltage having same polarity as an electric potential to which the surface of the photosensitive body is charged and an absolute value larger than the electric potential to the transfer member for a first period of time when image formation is not performed; and a second step of applying a second voltage having an absolute value smaller than the absolute value of the electric potential to which the surface of the photosensitive body is charged to the transfer member for a second period of time, which is not shorter than the first period of time, when image formation is not performed;

wherein the first period of time is set shorter than one driving cycle of the photosensitive body, and the second period of time is set longer than the one driving cycle.

14. An image forming apparatus for forming an image by charging a surface of a photosensitive body being driven and then exposing the surface light to form an electrostatic latent image, developing the electrostatic latent with toner having same polarity as a charge polarity of the surface of the photosensitive body to form a toner image, and transferring the toner image from the photosensitive body to a transfer material by driving the photosensitive body and a roller or belt-shaped transfer member while pressing the transfer material, comprising:

voltage application means for applying a first voltage having same polarity as an electric potential to which the surface of the photosensitive body is charged and an absolute value larger than the electric potential to the transfer member for a first period of time when image formation is not performed, and for applying a second voltage having an absolute value smaller than the absolute value of the electric potential to which the surface of the photosensitive body is charged to the transfer member for a second period of time, when image formation is not performed, wherein the transfer member is cleaned by the first voltage and the second voltage applied by the voltage application means, and wherein the first period of time is set shorter than one driving cycle of the photosensitive body, and the second period of time is set longer than the one driving cycle.

15. An image forming apparatus comprising:

a photosensitive body;

a charging device for charging a surface of the photosensitive body being driven;

an exposure device for exposing the surface of the photosensitive body to light to form an electrostatic latent image;

a developer device for developing the electrostatic latent image with toner having same polarity as a charge polarity of the surface of the photosensitive body to form a toner image;

a roller or belt-shaped transfer member for transferring the toner image from the photosensitive body to a transfer material by pressing the transfer material between the photosensitive body and the transfer member; and voltage applying a first voltage having same polarity as an electric potential to which the surface of the photosensitive body is charged and an absolute value larger than the electric potential to the transfer member for a first period of time when image formation is not performed; and a second voltage having an absolute value smaller than the absolute value of the electric potential to which the surface of the photosensitive body is charged to the transfer member for a second period of time, when image formation is not performed, wherein the first period of time is set shorter than one driving cycle of the photosensitive body, and the second period of time is set longer than the one driving cycle.

* * * * *